US012410661B2

(12) United States Patent
Nease et al.

(10) Patent No.: US 12,410,661 B2
(45) Date of Patent: Sep. 9, 2025

(54) CHAMFERED SINKER BAR CONNECTION

(71) Applicant: Percheron Manufacturing, Odessa, TX (US)

(72) Inventors: Mark Nease, Odessa, TX (US); Clois Montague, Odessa, TX (US)

(73) Assignee: Percheron Manufacturing, Odessa, TX (US)

( * ) Notice: Subject to any disclaimer, the term of this patent is extended or adjusted under 35 U.S.C. 154(b) by 0 days.

(21) Appl. No.: 18/778,355

(22) Filed: Jul. 19, 2024

(65) Prior Publication Data

US 2025/0034951 A1 Jan. 30, 2025

Related U.S. Application Data

(60) Provisional application No. 63/515,718, filed on Jul. 26, 2023.

(51) Int. Cl.
*E21B 17/00* (2006.01)
*E21B 17/042* (2006.01)

(52) U.S. Cl.
CPC ..... *E21B 17/006* (2013.01); *E21B 17/042* (2013.01)

(58) Field of Classification Search
CPC . E21B 17/042; E21B 17/0423; E21B 17/0426
See application file for complete search history.

(56) References Cited

U.S. PATENT DOCUMENTS 1,877,249 A * 9/1932 McHugh ..... E21B 47/0236 346/117 R
4,640,349 A * 2/1987 Allen ..... E21B 17/1071 166/241.2
6,352,107 B1 * 3/2002 Bennett ..... F04B 47/026 166/242.6
6,485,063 B1 * 11/2002 Olivier ..... F16L 15/08 285/333
2018/0163485 A1 * 6/2018 Song ..... E21B 43/127

* cited by examiner

*Primary Examiner* — David Carroll
(74) *Attorney, Agent, or Firm* — Vorys, Sater, Seymour and Pease LLP

(57) ABSTRACT

A sinker bar includes a cylindrical body having an outer surface terminating at a pin end. The pin includes a transition surface extending from an outer surface of the sinker bar and including a chamfered surface extending from the outer surface, an arcuate surface extending from the chamfered surface, and a straight-line surface extending from the arcuate surface, a tapered section extending from the straight-line surface, and a threaded section extending from the tapered section and terminating at a pin face.

20 Claims, 3 Drawing Sheets

CHAMFERED SINKER BAR CONNECTION

BACKGROUND

In the oil and gas industry, a sinker bar is a commonly utilized rod string component that is deployed to add weight to a rod string. Added weight may be desirable for any number of reasons not limited to overcoming downhole wellbore pressure, greater ease and efficiency in extending the rod string into a wellbore, as well as adding tension and or rigidity to the rod string. An operator may add any number of sinker bars that is procedurally desirable for the respective operation.

Typical sinker bars have opposing pin ends, thus the addition of sinker bars requires female-female couplings that interpose axially adjacent sinker bars. A successful coupling connection results in the greatest amount of surface contact between the pin end threads of the sinker bar and the internal threads of the coupling. In conventional sinker bar coupling configurations, the design of the pin end is sub-optimal, thus resulting in well operators over-torquing the coupling to the pin end, which frequently leads to cracked and failed couplings.

Accordingly, a connection that increases or maximizes the amount of surface contact between the external threads of the sinker bar and the internal threads of the coupling, and similarly increases the surface contact between the face of the pin and the face of the coupling, is desirable.

BRIEF DESCRIPTION OF THE DRAWINGS

The following figures are included to illustrate certain aspects of the present disclosure and should not be viewed as exclusive embodiments. The subject matter disclosed is capable of considerable modifications, alterations, combinations, and equivalents in form and function, without departing from the scope of this disclosure.

SUMMARY OF THE DISCLOSURE

Figure 1:
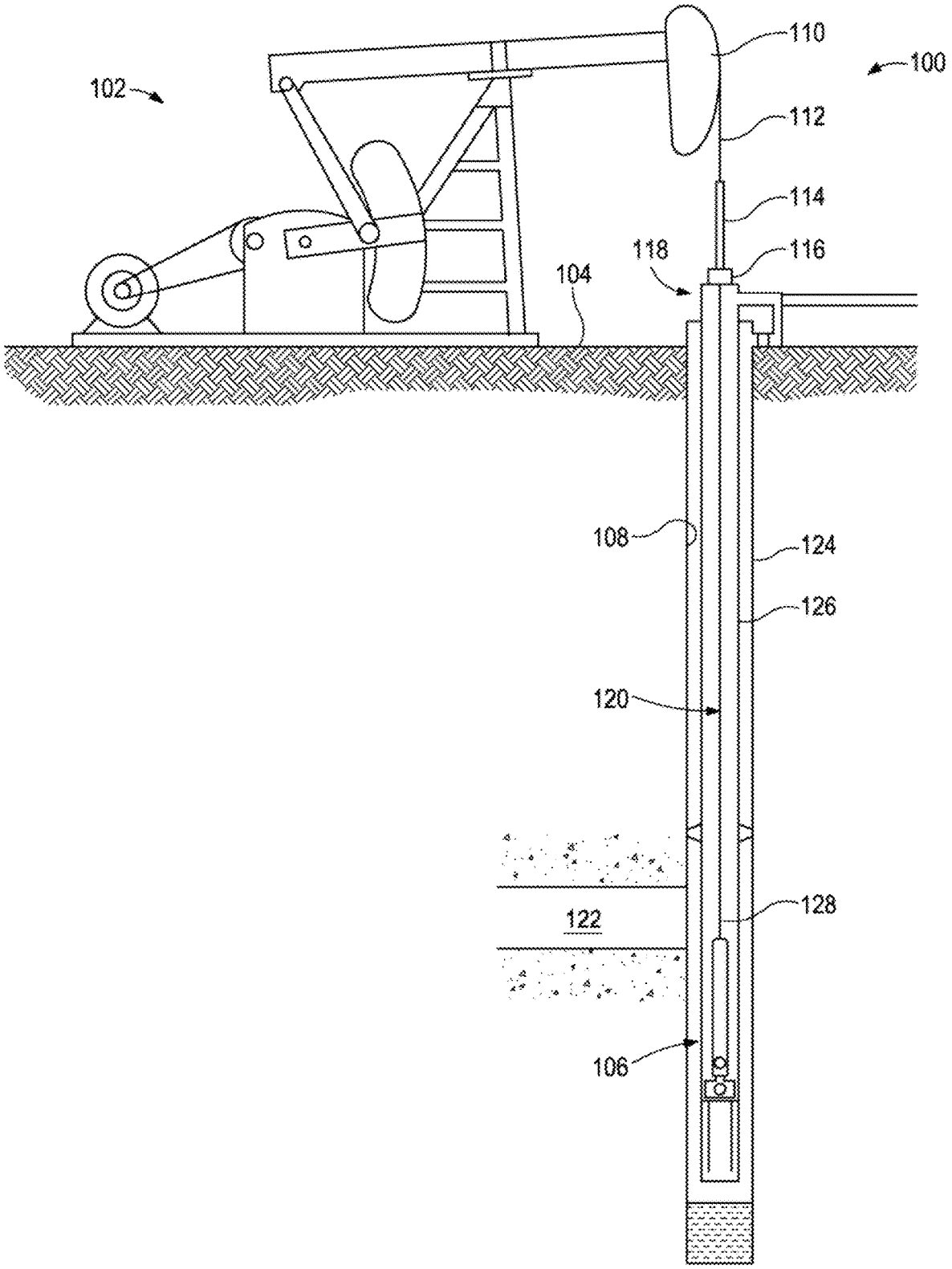
FIG. 1 is a schematic diagram of an example well system, according to one or more embodiments of the present disclosure.

Various details of the present disclosure are hereinafter summarized to provide a basic understanding. This summary is not an extensive overview of the disclosure and is neither intended to identify certain elements of the disclosure, nor to delineate the scope thereof. Rather, the primary purpose of this summary is to present some concepts of the disclosure in a simplified form prior to the more detailed description that is presented hereinafter.

Embodiments of the present disclosure include a sinker bar that includes a cylindrical body having an outer surface terminating at a pin end. The pin end may include a transition surface extending from an outer surface of the sinker bar and including a chamfered surface extending from the outer surface, an arcuate surface extending from the chamfered surface, and a straight-line surface extending from the arcuate surface, a tapered section extending from the straight-line surface, and a threaded section extending from the tapered section and terminating at a pin face.

Embodiments of the present disclosure may further include a pin end of a rod string component, including a transition surface extending from an outer surface of the rod string component. The transition surface may include a chamfered surface extending from the outer surface, an arcuate surface extending from the chamfered surface, and a straight-line surface extending from the arcuate surface.

The pin end may further include a tapered section extending from the straight-line surface, and a threaded section extending from the cone section and terminating at a pin face.

Embodiments of the present disclosure may further include a method of making-up a pin end of a sinker bar, the method may include advancing the pin end into an interior of a coupling that defines internal threading, the pin end extending from an outer surface of a cylindrical body of the sinker bar and including a transition surface extending from an outer surface of the sinker bar and including a chamfered surface extending from the outer surface, an arcuate surface extending from the chamfered surface, and a straight-line surface extending from the arcuate surface, a tapered section extending from the straight-line surface, and a threaded section defining external threading and extending from the tapered section and terminating at a pin face. The method may further include rotating at least one of the pin end and the coupling and thereby threadably mating the internal and external threading.

DETAILED DESCRIPTION

Embodiments in accordance with the present disclosure generally relate to sinker bars used in the oil and gas industry and, more particularly, to improved pin end designs and threading for sinker bars.

Embodiments disclosed herein describe sinker bars having a pin end connection operable to couple to a universal coupling, where the connection is matable as designed and there exists little to no space (or "gap") between the shoulder of the pin end connection and the coupling. The pin end designs disclosed herein are configured to maximize the surface contact area between the external threads of the pin end and the internal threads of a receiving coupling. The presently disclosed pin end designs can maximize surface face contact between the face of the pin and the face of the coupling when the sinker bar and the coupling are connected and torqued.

The pin end designs described herein are compatible with a ¾" (0.75 inch) polished rod pin end that has been implemented in sinker bars having an outer diameter of 1¼" (1.25 inches). Polished rods and their connections are subject to the dimensional tolerances specified by the governing industry/regulatory body, the American Petroleum Institute (API). Accordingly, the pin end designs disclosed herein abide by the applicable API requirements and simultaneously provide for an optimal connection between the sinker bar and a coupling without over-torquing, and thus potentially damaging the coupling.

FIG. 1 is a schematic view of an example well system 100 that may employ the principles of the present disclosure. The well system 100 includes a pumping unit 102 positioned at a well surface 104. The pumping unit 102 is known in the industry by many names, including, but not limited to, a "pumpjack," a "nodding donkey pump," or a "horsehead pump", and is configured to drive (operate) a submersible pump 106 arranged within a wellbore 108. As illustrated, the pumping unit 102 includes a horse head 110 to which a cable 112 (alternately referred to as a "bridle") is attached. A polished rod 114 is attached to the distal end of the cable 112 and extends through a stuffing box 116 forming part of a wellhead 118 that caps the wellbore 108. The polished rod 114 is reciprocated within stuffing box 116 as the horse head 110 moves (reciprocates) up and down.

The polished rod 114 forms part of or is otherwise operatively coupled to a rod string 120 extended into the wellbore 108.

As shown, the wellbore 108 extends vertically into a subterranean formation and penetrates a hydrocarbon-bearing reservoir 122. The wellbore 108 may be lined with casing 124 that extends to (or toward) the bottom (most distal end) of the wellbore 108. An extension of tubing 126 extends from the wellhead 118 and is concentrically arranged within the casing 124. The tubing 126 terminates at a predetermined distance from the bottom of the wellbore 108.

The rod string 120 may include a variety of components that enable pumping of hydrocarbons migrating into the wellbore 108 to the well surface 104 using the pumping unit 102. For example, the rod string 120 can include the submersible pump 106 arranged at the distal end of the rod string 120 and one or more sinker bars 128. The sinker bar 128 comprises a weighted component made of a high-density material and used to maintain tension in the rod string 120. When used in a slickline operation, the sinker bar 128 may help overcome the effects of pressure and friction caused by the wellhead 118.

The sinker bar 128 may be operatively coupled to the submersible pump 106, either directly or indirectly. In some applications, one or more stabilizing components (not shown) may be included in the rod string 120 and interpose the submersible pump 106 and the sinker bar(s) 128. The sinker bar(s) 128 may be arranged within and operatively coupled to any matable component within the rod string 120.

Those of ordinary skill in the art will be familiar with polished rods. Generally, a polished rod is the uppermost component of the rod string 120. The API sets forth requirements and acceptable tolerances for polished rods and their respective connections. Although specifically designed for polished rods, over time, the oil and gas industry has adopted a ¾" (0.75 inch) polished rod specific connection, and implemented the connection in 1¼" (1.25 inch) sinker bars, for which the connection was not designed.

Sinker bars (e.g., the sinker bar 128) are generally manufactured so that opposing ends of the sinker bar terminate at a pin end connection that includes a radial shoulder that extends substantially perpendicular to the longitudinal axis of the sinker bar. Accordingly, the radial shoulder of conventional sinker bars commonly comprises a 90° transition to the pin end connection. Depending on the design of the coupling used to mate with the sinker bar pin end connection, the radial shoulder can cause issues when mating (making up) the 1¼" sinker bar with the ¾" polished rod connection to a coupling, for the purposes of creating the rod string 120 extended into the wellbore 108.

Sinker bar couplings are often manufactured with an internal bevel that extends from the face of the coupling, as described in more detail below with reference to FIGS. 2 and 3. Internal threads are defined within the interior of the coupling at a predetermined distance from the bevel. Generally, the bevel exhibits an angle of either 45° or 30°. Because of the API specified dimensions for the ¾" polished rod pin end connection, upon make-up, the 90° shoulder prevents full engagement between the sinker bar threads (comprising the polished rod pin end connection) and the internal threads of the coupling. Instead, the configuration causes the threads to "lock up" prior to fully engaging the coupling. Such lock up creates a gap between the uppermost portion of the coupling (the face) and the radial shoulder of the sinker bar 128.

In an effort to eliminate the gap, rig site operators will over-torque the connection, which oftentimes results in cracking or damaging the coupling. In the alternative, the inverse can occur during make-up, where the shoulder of the sinker bar pin bottoms out on the shoulder of the coupling before the internal tapered area of the threaded portion of the pin end is able to properly seat. When this happens, galling occurs on the face of the coupling and also on the face of the sinker bar.

According to embodiments of the present disclosure, this issue may be mitigated, or eliminated entirely, via a re-design of the 1¼" sinker bar 128 featuring a ¾" polished rod connection, as disclosed herein. Although, the present disclosure pertains to a re-design of the 1¼" sinker bar 128 with a ¾" polished rod connection, other embodiments may comprise a sinker bar 128 having an outer diameter of 1⅜", 1½", 1⅝" 1¾" or 2". Similarly, the embodiments disclosed herein may also comprise polished rod connections including ¾", ⅞" or 1".

Figure 2:
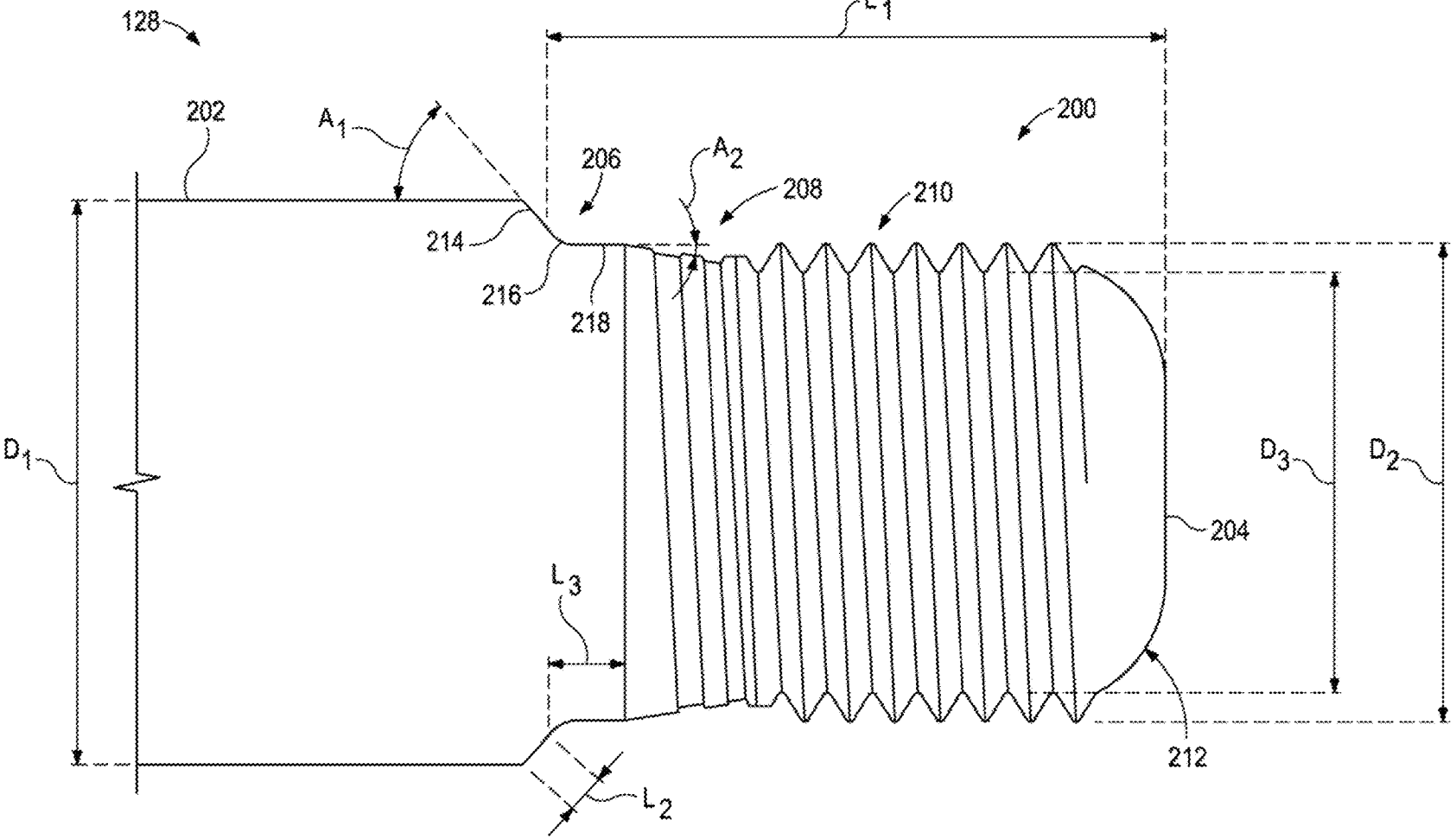
FIG. 2 is a side view of a pin end of a sinker bar, according to one or more embodiments of the present disclosure.

FIG. 2 is an enlarged side view of an example pin end connection or "pin end" 200 of the sinker bar 128 of FIG. 1, according to one or more embodiments of the present disclosure. As illustrated, the sinker bar 128 comprises a cylindrical solid body having a generally smooth outer surface 202 that exhibits an outer diameter D1. In at least one embodiment, the outer diameter D1 may be about 1¼" (1.25 inches), but may be more or less than 1¼", as governed by API required tolerances (i.e., +0.005, −0.010).

The sinker bar 128 terminates with the pin end 200, which exhibits a pin length L1. In some applications, the pin length L1 may accord with API standard pin lengths. In such embodiments, for instance, the pin length L1 may be about 1.375 inches, but could alternatively be slightly longer or shorter depending on the application or resulting from manufacturing tolerances.

The pin end 200 includes multiple features that ultimately terminate at a pin face 204, which constitutes the distal-most point of the sinker bar 128. As illustrated, the pin end 200 may include a transition profile 206 that transitions from the outer surface 202, a tapered section 208 that transitions from the transition profile 206, external threading 210 that transitions from the tapered section 208, and a pin face arcuate surface 212 that provides a transition from the external threading 210 to the pin face 204.

The external threading 210 may be configured to mate with internal threading defined on a coupling (not shown). In such embodiments, the external threading 210 and the corresponding internal threading of the coupling may comprise matable, helical threads. Operatively coupling and threading the pin end 200 to a coupling enables the rod string 120 (FIG. 1) to be extended into the wellbore 108 (FIG. 1). To ensure proper make-up of the sinker bar 128 to a coupling, it is advantageous that the respective threads are both engaged and torqued as designed. As illustrated, the external threading 210 includes a major diameter D2, which may range between about 1.0482 inches and about 1.0612 inches, and a minor diameter D3, which may be about 0.9384 inches. The pin face arcuate surface 212 may exhibit an arc length radius of about 0.2810 inches. As will be appreciated, however, the foregoing dimensions may be altered depending on the application.

In the illustrated embodiment, the transition profile 206 may define or otherwise provide multiple contiguous surfaces that provide a transition between the outer surface 202 of the sinker bar 128 at the outer diameter D1 to the tapered section 208. In at least one embodiment, as illustrated, the transition profile 206 may include a straight or "chamfered" surface 214 that extends from the outer surface 202, an arcuate surface 216 that extends from the chamfered surface 214, and a straight-line surface 218 that extends from the arcuate surface 216.

The chamfered surface 214 extends from the outer surface 202 at an angle A1, which, in at least one embodiment, may be 45°. In other embodiments, however, and in accordance with API recommendations, the angle A1 may be that which is operationally feasible and desirable to the manufacturer. The chamfered surface 214 may extend between the outer surface 202 and the arcuate surface 216 over a length L2, which may be about 0.0738 inches.

The chamfered surface 214 transitions directly into the arcuate surface 216, which may exhibit an arc length radius of about 0.0938 inches. The arcuate surface 216 transitions directly into the straight-line surface 218. In some embodiments, the straight-line surface 218 extends parallel to the outer surface 202 and otherwise parallel to the central axis of the sinker bar 128. In at least one embodiment, the arcuate surface 216 and the straight-line surface 218 may exhibit a combined axial length L3 of about 0.175 inches before transitioning to the tapered section 208. In other embodiments, the length L3 may be greater than 0.175 inches but less than about 0.225 inches. In yet another embodiment, the length L3 may be 0.225 inches in length. Accordingly, in at least one embodiment, the transition profile 206 includes three contiguous and continuous surfaces, including the chamfered surface 214, the arcuate surface 216, and the straight-line surface 218.

The tapered section 208 may extend from the straight-line surface 218 at an angle A2, which may be about 9°, as specified by API requirements. In some embodiments, as illustrated, the external threading 210 may extend into the tapered section 208, but at a reduced diameter. In other embodiments, however, the external threading 210 may stop before entering the tapered section 208. In such embodiments, the tapered section 208 may exhibit a substantially smooth outer surface.

While the pin end 200 is described herein as forming part of the sinker bar 128, it is contemplated herein that the pin end 200 may alternatively be implemented in any downhole rod string connection. Accordingly, manufacture of the pin end 200 is not limited to the sinker bar 128, and implementation in a component other than a sinker bar or polished rod does not exceed the scope of this disclosure.

Figure 3:
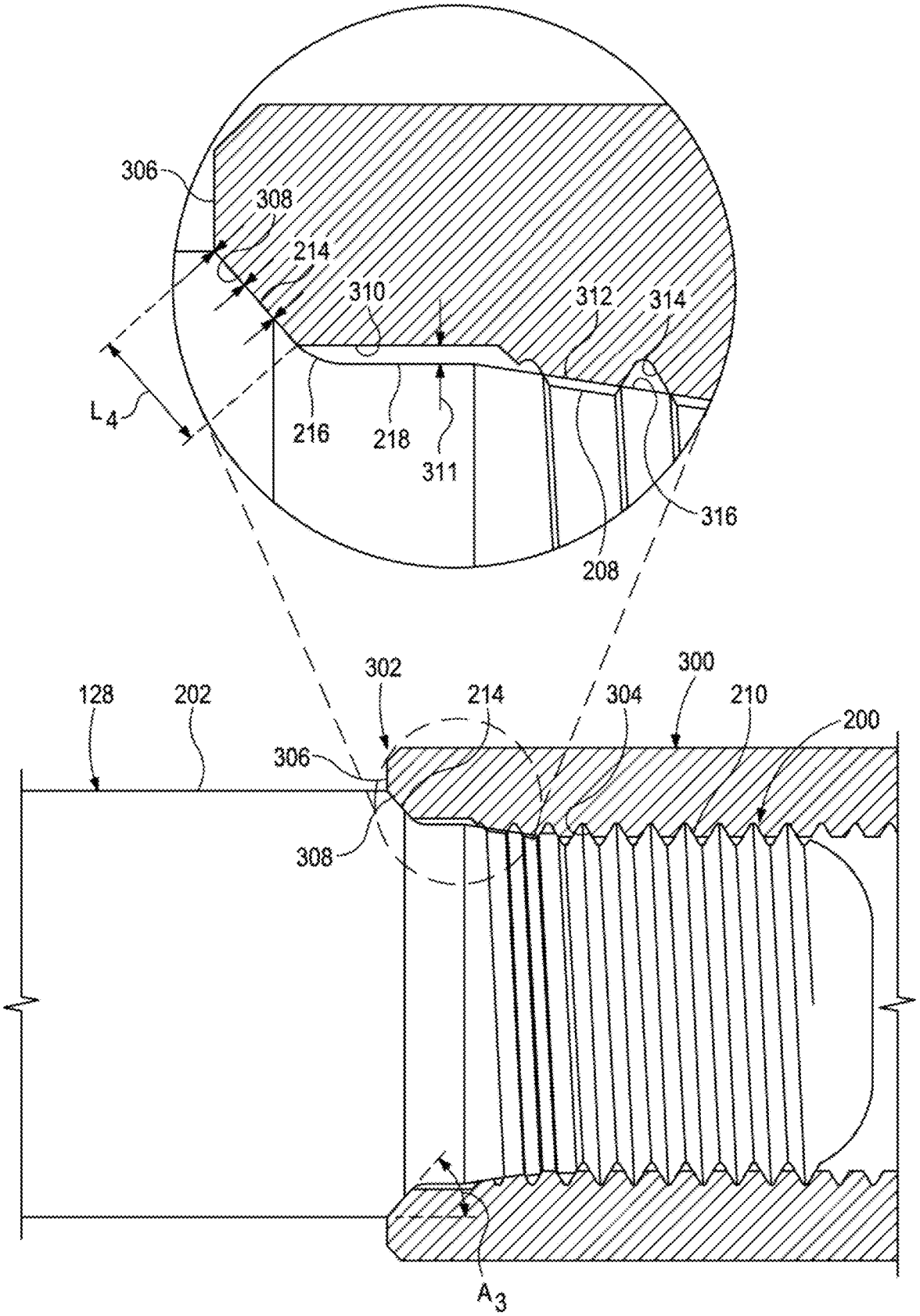
FIG. 3 is a partial side view of a threaded engagement between the pin end of the sinker bar and an example coupling, according to one or more embodiments of the present disclosure.

FIG. 3 is a partial side view of a threaded engagement between the pin end 200 and an example coupling 300, according to one or more embodiments of the present disclosure. FIG. 3 also provides an enlarged inset graphic of a portion of the threaded engagement.

As illustrated, the pin end 200 is sized to be received within the coupling 300 at one end 302 of the coupling 300. The interior of the coupling 300 defines or otherwise provides internal threading 304 configured to threadably mate with the external threading 210 of the pin end 200. The end 302 of the coupling 300 provides a face 306, which comprises a generally flat surface extending substantially perpendicular to the outer surface 202 of the sinker bar 128. The face 306 transitions to an internal bevel 308 extending from the face 306 at an angle A3. In some embodiments, the angle A3 may be the same as the angle A1 (FIG. 2), thereby enabling mating engagement between the internal bevel 308 and the chamfered surface 214. In such embodiments, the angles A1, A3 may each be about 45°, which allows the internal bevel 308 to make contact with the entire length L2 (FIG. 2) of the chamfered surface 214, as indicated by the opposing angles provided in the enlarged inset graphic.

In other embodiments, however, the angle A3 of the internal bevel 308 may be 30°, without departing from the scope of the disclosure. As those of ordinary skill will be familiar, 45° and 30° machined angle(s) A3 are considered to be standard. However, the scope of this disclosure is not intended to limit the angle A3 of the internal bevel 308. Accordingly, a manufacturer may machine another angle A3 at their discretion without exceeding the scope of this disclosure.

Because the sinker bar 128 includes the chamfered surface 214, as opposed to a traditional 90° radial shoulder, the chamfered surface 214 is able to align and make significant surface contact with the internal bevel 308 of the coupling 300. This may prove advantageous in enabling an increased amount of surface contact between the internal bevel 308 and the chamfered surface 214, as compared to a sinker bar with a conventional 90° radial shoulder.

As best seen in the enlarged inset graphic, the internal bevel 308 exhibits a length L4, which may be greater than the length L2 of the chamfered surface 214. In the illustrated embodiment, for example, the length L4 of the internal bevel 308 extends into the arcuate surface 216 of the transition profile 206 (FIG. 2) for the pin end 200. The internal bevel 308 may then transition into a straight-line section 310 that extends substantially parallel to the straight-line surface 218 of the transition profile 206. In at least one embodiment, as illustrated, a gap 311 may be defined between the straight-line section 310 and the straight-line surface 218 when the coupling 300 is fully threaded to the pin end 200.

The straight-line section 310 may then transition to an internal cone section 312 configured to matably engage the tapered section 208 of the pin end 200. In some embodiments, the cone section 312 may extend at an angle substantially similar to the angle A2 (FIG. 2) of the tapered section 208. In some embodiments, as illustrated, the cone section 312 may define internal threading 314. In embodiments where the tapered section 208 includes external threading 316, as illustrated, the internal threading 314 may be configured to threadably mate with the external threading 316.

The configuration described herein allows for threaded engagement between the sinker bar 128 and the coupling 300 while simultaneously allowing for proper surface contact between the internal bevel 308 of the coupling 300 and the chamfered surface 214 of the pin end 200. By providing substantial engagement between the opposing chamfered surface 214 and the internal bevel 308, and threaded engagement between the external and internal threading 210, 304, proper torque may be applied by the operator to make-up the coupling 300. This may eliminate any gap between the face 306 of the coupling 300 and the transition profile 206 (FIG. 2) of the sinker bar 128 and, as a result, mitigating damage to the coupling 300 during make-up (i.e., threading the coupling 300 onto the pin end 200).

Alternatively, due to design tolerances (i.e., tolerance stack-up), there may be instances when the tapered section 208 does not exactly (or closely) align with the corresponding threads of the coupling 300. In such instances, because the sinker bar 128 includes the chamfered surface 214 as opposed to a traditional 90° radial shoulder, adequate surface contact is still achievable between the internal bevel 308 of the coupling 300 and the chamfered surface 214 of the sinker bar 128. This configuration still allows adequate torque, within API tolerances, to be applied and achieved.

As used herein, the phrase "at least one of" preceding a series of items, with the terms "and" or "or" to separate any of the items, modifies the list as a whole, rather than each member of the list (i.e., each item). The phrase "at least one of" allows a meaning that includes at least one of any one of the items, and/or at least one of any combination of the items, and/or at least one of each of the items. By way of example, the phrases "at least one of A, B, and C" or "at least one of A, B, or C" each refer to only A, only B, or only C; any combination of A, B, and C; and/or at least one of each of A, B, and C.

The use of directional terms such as above, below, upper, lower, upward, downward, left, right, uphole, downhole and the like are used in relation to the illustrative embodiments as they are depicted in the figures, the upward direction being toward the top of the corresponding figure and the downward direction being toward the bottom of the corresponding figure, the uphole direction being toward the surface of the well and the downhole direction being toward the toe of the well.

What is claimed is:

1. A sinker bar, comprising:

a cylindrical body having an outer surface terminating at a pin end, the pin end including:

a transition surface extending from an outer surface of the sinker bar and including a chamfered surface extending from the outer surface, an arcuate surface extending from the chamfered surface, and a straight-line surface extending from the arcuate surface;

a tapered section extending from the straight-line surface; and a threaded section extending from the tapered section and terminating at a pin face, wherein the tapered section axially interposes the straight-line surface and the threaded section.

2. The sinker bar of claim 1, wherein the chamfered surface extends from the outer surface at an angle of 45 degrees.

3. The sinker bar of claim 1, wherein the chamfered surface extends from the outer surface at an angle of 30 degrees.

4. The sinker bar of claim 1, wherein the outer surface exhibits a diameter of 1¼ inches.

5. The sinker bar of claim 1, wherein the outer surface exhibits a diameter selected from the group consisting of 1¼ inches, 1⅜ inches, 1½ inches, 1⅝ inches, 1¾ inches, and 2 inches.

6. The sinker bar of claim 1, wherein the threaded section defines external threads threadably matable with internal threads defined within a coupling.

7. The sinker bar of claim 6, wherein the coupling defines an internal bevel engageable with the chamfered surface.

8. A pin end of a rod string component, comprising:

a transition surface extending from an outer surface of the rod string component, the transition surface including:

a chamfered surface extending from the outer surface;

an arcuate surface extending from the chamfered surface; and a straight-line surface extending from the arcuate surface;

a tapered section extending from the straight-line surface; and a threaded section extending from the tapered section and terminating at a pin face, wherein the tapered section axially interposes the straight-line surface and the threaded section.

9. The pin end of claim 8, wherein the threaded section defines external threads that are threadably matable with internal threads defined by a coupling.

10. The pin end of claim 8, wherein the chamfered surface extends from the outer surface at an angle of 45°.

11. The pin end of claim 8, wherein the chamfered surface exhibits a length of about 0.0738 inches.

12. The pin end of claim 8, wherein the rod string component exhibits a diameter of about 1¼ inches.

13. The pin end of claim 8, wherein the tapered section extends from the straight-line surface at an angle of 9°.

14. The pin end of claim 8, wherein the rod string component comprises a sinker bar.

15. A method of making-up a pin end of a sinker bar, the method comprising: advancing the pin end into an interior of a coupling that defines internal threading, the pin end extending from an outer surface of a cylindrical body of the sinker bar and including:

a transition surface extending from an outer surface of the sinker bar and including a chamfered surface extending from the outer surface, an arcuate surface extending from the chamfered surface, and a straight-line surface extending from the arcuate surface;

a tapered section extending from the straight-line surface; and a threaded section defining external threading and extending from the tapered section and terminating at a pin face, wherein the tapered section axially interposes the straight-line surface and the threaded section; and rotating at least one of the pin end and the coupling and thereby threadably mating the internal and external threading.

16. The method of claim 15, wherein an end of the coupling provides a face extending perpendicular to the outer surface of the sinker bar, and the face transitions to an internal bevel extending from the face at an angle offset from perpendicular, wherein rotating the at least one of the pin end and the coupling comprises rotating the at least one of the pin end and the coupling until the internal bevel engages against the chamfered surface.

17. The method of claim 16, wherein the chamfered surface and the internal bevel each exhibit an angle of 45 degrees.

18. The method of claim 16, wherein the internal bevel exhibits an angle of 30 degrees.

19. The method of claim 16, wherein the internal bevel exhibits a length greater than a length of the chamfered surface.

20. The method of claim 16, wherein the internal bevel transitions into a straight-line section extending substantially parallel to the straight-line surface, and wherein a gap is defined between the straight-line section and the straight-line surface.

* * * * *